United States Patent [19]

Sugarman et al.

[11] Patent Number: 4,941,576

[45] Date of Patent: Jul. 17, 1990

[54] HOLDER FOR A TAPE MARKER FLAG DISPENSER AND THE LIKE

[75] Inventors: Louis Sugarman, Barrington; Max B. Dressler, Warwick, both of R.I.

[73] Assignee: Alcraft, Inc., Pawtucket, R.I.

[21] Appl. No.: 338,230

[22] Filed: Apr. 13, 1989

[51] Int. Cl.[5] ..... A47F 7/00

[52] U.S. Cl. ..... 211/13; 211/50; 211/69.1; 206/214

[58] Field of Search ..... 211/50, 69.1, 43, 69.5, 211/13, 162, 13; 206/214, 215, 425, 555

[56] References Cited

U.S. PATENT DOCUMENTS

| | | | |
|---|---|---|---|
| 2,684,765 | 7/1954 | Lowenstein | 211/43 |
| 2,911,103 | 11/1959 | Kunkler | 211/43 |
| 4,176,743 | 12/1979 | Fitzpatrick | 206/214 |
| 4,190,166 | 2/1980 | Allsop | 211/162 X |
| 4,667,828 | 5/1987 | Samuelson | 206/555 |
| 4,696,399 | 9/1987 | Windorski | 206/215 X |
| 4,865,223 | 9/1989 | Huang | 206/214 X |

*Primary Examiner*—Robert W. Gibson, Jr.
*Attorney, Agent, or Firm*—Salter & Michealson

[57] ABSTRACT

A holder for a dispenser for tape marker flags of a type which includes a body portion containing a supply of tape marker flags and an upwardly opening tubular neck portion on the body portion through which tape marker flags can be individually dispensed. The holder includes a channel member which is adapted to be received on a supporting surface, wherein the channel member has an elongated channel formed therein including an enlarged inner portion and a reduced upwardly opening mouth portion. The channel is dimensioned for receiving a tape marker flag dispenser therein so that the body portion of the dispenser is received in the enlarged inner portion of the channel and the neck portion of the dispenser extends upwardly into the open mouth portion of the channel so that tape marker flags can be individually dispensed from the neck portion of the dispenser as needed. Although the holder has particular utility with respect to tape marker flag dispensers it also may receive other products configured so to be slidably received within the channel member and the mouth portion thereof, such other products either being in lieu of or in addition to the tape marker flag dispenser.

12 Claims, 2 Drawing Sheets

HOLDER FOR A TAPE MARKER FLAG DISPENSER AND THE LIKE

BACKGROUND AND SUMMARY OF THE INVENTION

The instant invention relates to desk-top accessories and more particularly to a holder for holding and positioning articles, such as a dispenser for tape marker flags and the like on a desk-top or counter-top surface.

Tape marker flags, such as POST-IT (3M Corporation TM) marker flags have been found to be effective for marking the pages of various books, pamphlets, files, etc. In this regard, tape marker flags of this type generally comprise a tape portion having an adhesive on one surface thereof and a marker portion which is preferably made from a relatively durable yet flexible plastic material and attached to the tape portion at one end thereof. A tape marker flag of this type can generally be effectively utilized for marking a selected page of a book or pamphlet by securing the tape portion of the marker flag to the edge portion of the page so that the marker portion projects outwardly beyond the edge of the page. Accordingly, when a tape marker flag is secured to a page the marker portion of the flag can be effectively used to rapidly locate the page when desired.

It has recently been found that tape marker flags of the above described type can be effectively packaged and sold in dispensers which are adapted for individually dispensing tape marker flags as they are needed. Specifically, it has been found that they can be packaged and dispensed from dispensers of a type comprising a housing including an enlarged rectangular body portion of reduced height containing a supply of tape marker flags and an upwardly extending open ended tubular neck portion of elongated cross sectional length and reduced cross sectional width on the body portion. Tape marker flags are generally assembled in a dispenser of this type so that one of the marker flags is located in a dispensing position wherein the marker portion of the flag extends upwardly a short distance from the neck portion so that it can be grapsed by a user. Tape flags are further generally assembled so that each time a flag is dispensed by pulling it outwardly from the neck portion, a new tape flag is moved into the dispensing position in the neck portion so that the tape flags in the body portion can be individually and sequentially dispensed through the neck portion as they are needed.

Unfortunately, it has been found that dispensers for tape marker flags of the above described type are often lost or misplaced when they are placed on desk-top or counter-top surfaces and therefore they are often not readily available when needed. For this reason, it has been found that there is a need for an effective holder for receiving and positioning a dispenser for tape flags of the above described type on a surface, such as a desk-top or counter-top surface so that the tape marker flags therein can be individually dispensed as needed.

The instant invention provides an effective holder for a dispenser for tape marker flags of the above described type which is adapted to be received on a supporting surface, such as a desk-top or counter-top surface. Specifically, the holder of the instant invention comprises an elongated channel member having an upper surface and having an elongated channel therein which opens upwardly through the upper surface. The channel member is adapted to be received and supported on a supporting surface so that the upper surface faces upwardly and the channel includes an enlarged inner portion and a reduced mouth portion which defines an elongated slot of reduced width in the upper surface. The channel in the channel member has at least one open end and it is dimensioned for receiving a dispenser for tape marker flags through the open end thereof so that the body portion of the dispenser is slidably received in the enlarged inner portion of the channel and so that the neck portion extends upwardly into the reduced mouth portion of the channel terminating at a point adjacent the upper surface. The mouth portion of the channel is preferably dimensioned for snugly postioning the neck portion of the dispenser in substantially longitudinally aligned relation therein and the mouth portion is further dimensioned for preventing removal of the dispenser from the channel through the mouth portion. The channel member is preferably formed as an elongated extruded channel member of either metal or plastic having a substantially uniform cross section and the holder preferably includes a pair of end caps for removably closing the opposite ends of the channel. The holder of the instant invention can be effectively adapted to include a pair of channel members and, in this case, one of the end caps is adapted to releasably connect the two channel members together in substantially aligned end to end relation. The holder is also adapted to receive products other than tape marker flag dispensers such as a time piece and a time piece support which is slidably receivable in the channel so that it extends upwardly through the open mouth portion thereof for supporting a time piece above the channel member. The holder can also be adapted to include a writing instrument and a writing instrument holder on the channel member and it can be adapted for receiving and positioning a note pad on the upper surface of the channel member. Specifically, the upper surface of the channel member can be adapted to include a pair of spaced substantially longitudinally extending, parallel rails which define a pair of opposed, substantially parallel, longitudinally extending, raised edges on the upper surface which are engageable with the opposite edges of a note pad to retain the note pad in position on the channel member.

Accordingly, it is a primary object of the instant invention to provide an effective holder which is receivable on a supporting surface, such as a desk-top or a counter-top and operative for receiving and postioning a dispenser for tape marker flags thereon.

Another object of the instant invention is to provide an effective holder for a dispenser for tape marker flags, wherein the holder includes a channel member having an elongated channel formed therein which is operative for receiving and positioning a dispenser for tape marker flags so that marker flags can be readily dispensed through an open mouth portion of the channel.

Another object of the instant invention is to provide a holder for a dispenser for tape marker flags which is adapted to receive various other desk accessories, such as a time piece, a note pad and/or a writing instrument.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
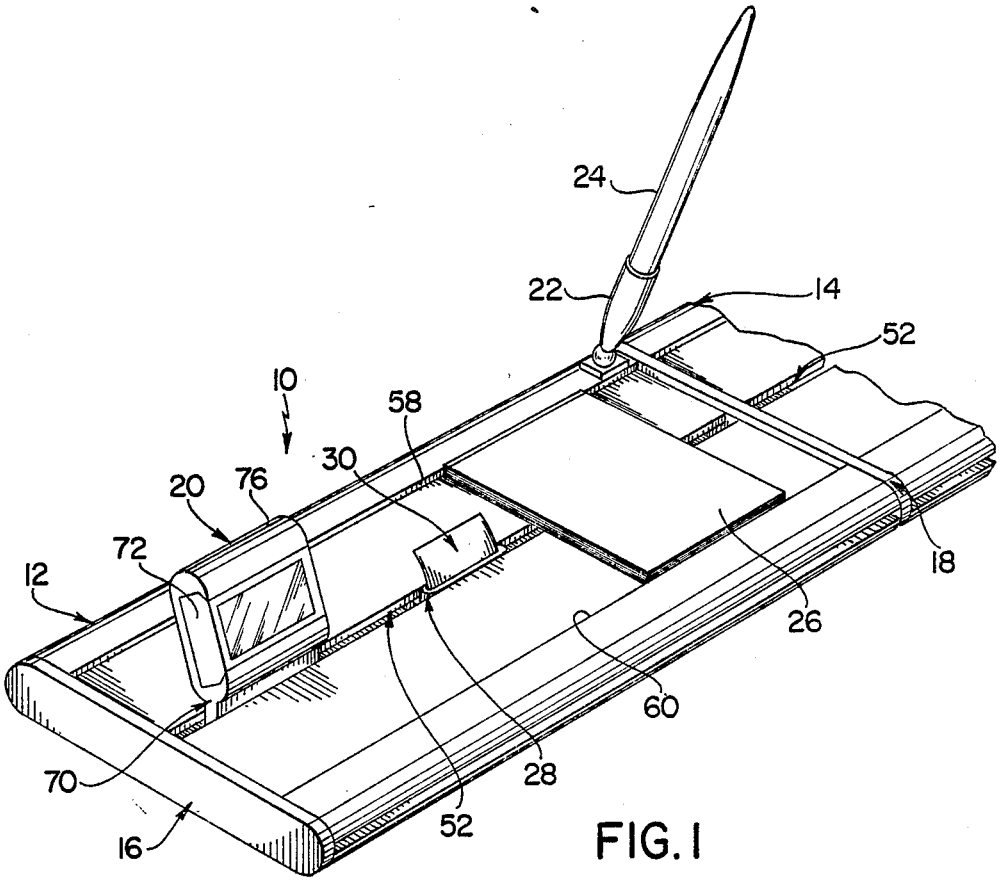
FIG. 1 is a perspective view of the holder of the instant invention.
Figure 3:
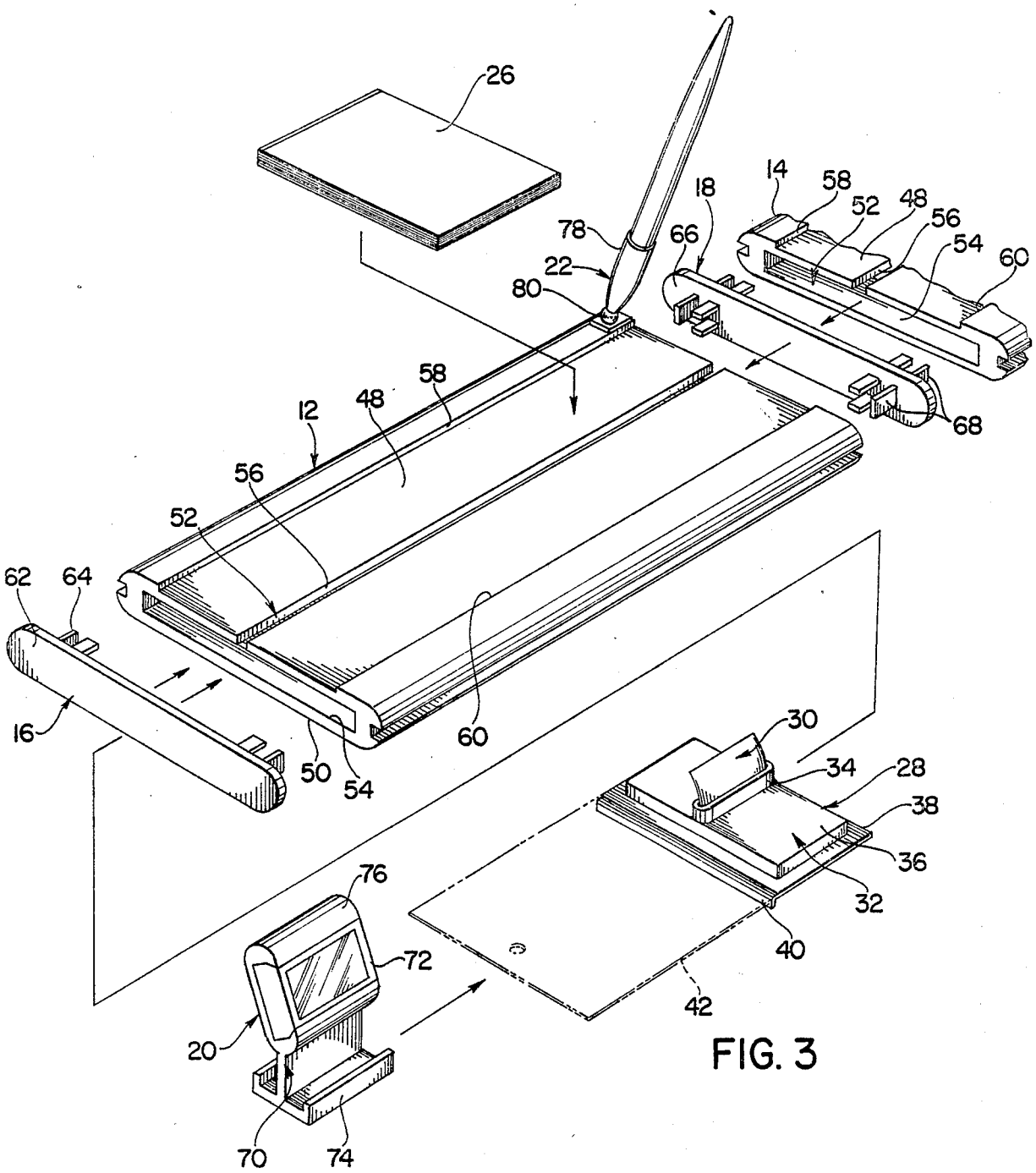
FIG. 3 is an exploded perspective view of the holder.

Referring now to the drawings, the holder for articles of the instant invention is illustrated and generally indicated at 10 in FIGS. 1 and 3. The holder 10 comprises first and second elongated channel members 12 and 14, respectively, a pair of end caps generally indicated at 16 and 18, respectively, a time piece assembly generally indicated 20, a pen holder 22 containing a pen 24, and a note pad 26. The holder 10 is adapted to be received on a supporting surface such as a desk-top or a counter-top and it is operative for receiving and positioning an article, such as a tape marker flag dispenser 28 containing a supply of tape marker flags 30 so that the marker flags 30 can readily be individually dispensed from the dispenser 28 as needed.

Figure 2:
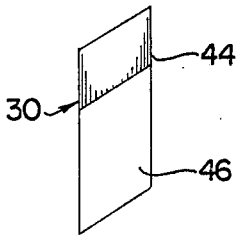
FIG. 2 is a perspective view of a tape marker flag.

The dispenser 28 preferably comprises a commercially available tape marker flag dispenser, such as a dispenser containing a supply of POST-IT (3M Corporation TM) tape marker flags of the type manufactured and marketed by the 3M Corporation of Saint Paul, Minn. The dispenser 28 comprises a body portion generally indicated at 32 having an upstanding open-ended tubular neck portion 34 thereon. The body portion 32 preferably comprises a substantially rectangular plastic shell 36 having an outwardly projecting lower flange 38 and a card portion 40 which is adhesively secured to the underside of the flange 38. The card portion 40 is preferably made from a suitable cardboard material and is normally integrally formed with a display card portion 42 which is adapted to be normally torn off and discarded prior to use of the dispenser 28. In this regard, once the display card portion 42 has been severed from the card portion 40 any free edge portions of the card portion 40 can be bent downwardly as illustrated in FIG. 3 in order to adapt the dispenser 28 to fit more tightly in the channel member 12 as will hereinafter be more fully set forth. The neck portion 34 extends integrally upwardly from the shell portion 36 and it has a cross sectional length which corresponds to the width of a marker flag 30. As illustrated in FIG. 2, the marker flags 30 each comprise a flag portion 44 and a tape portion 46. A supply of the flags 30 is assembled in the body portion 32 so that each time a flag 30 is drawn outwardly through the neck portion 34 a new tape marker flag 30 is advanced into a dispensing position wherein it projects outwardly from the open neck portion 34.

The channel members 12 and 14 are preferably extruded from a suitable plastic or metallic material and each has an upper surface 48 and a substantially flat lower surface 50 which is adapted to be received on a supporting surface. The channel members 12 and 14 are generally of elongated configuration and each has an elongated longitudinally extending channel generally indicated at 52 therein which includes an enlarged inner portion 54 and a reduced mouth portion or slot 56 which opens upwardly along the upper surface 48 thereof. Each of the channels 52 extends along the entire length of the respective channel member 12 or 14 thereof, although other embodiments of the holder of the instant invention which include one or more channel members having channels therein which extend only partially along the respective lengths thereof are contemplated. Each of the channels 52 is dimensioned for receiving a dispenser 28 therein so that the body portion 32 of the dispenser 28 is received in the inner portion 54 of the channel 52 and so that the open neck portion 34 of the dispenser 28 extends upwardly into the open mouth portion 56 of the channel 52 to a point adjacent the upper surface 48 thereof. When the dispenser 28 is received in one of the channel members 12 or 14 in this manner the marker flags 30 therein can be readily dispensed from the tubular neck portion 34 thereof by individually drawing the marker flags 30 outwardly from the neck portion 34. The upper surface 48 of each of the channel members 12 and 14 is recessed slightly and the opposite longitudinally extending edges of each of the upper surfaces 48 are defined by a pair of spaced, substantially parallel, slightly raised rails 58 and 60.

The end cap 16 is preferably made from a suitable plastic or metallic material and it includes an end plate portion 62 and a plurality of resilient fingers 64 which extend outwardly from one side of the plate portion 62. The fingers 64 are positioned and dimensioned to be frictionally received in the inner portion 54 of the channel 52 at one end of the channel member 12 for substantially closing one end of the channel 52.

The end cap 18 includes a plate portion 66 and a plurality of resilient fingers 68 which extend outwardly from opposite sides of the plate portion 66. The fingers 68 are dimensioned and positioned to be frictionally received in the inner portions 54 of the channels 52 in the channel members 12 and 14 so that the cap 18 closes off the adjacent ends of the channels 52 and the outwardly extending fingers 68 permit detachable interconnection of the channel members 12 and 14 in substantially end to end aligned relation.

The time piece assembly 20 includes a holder portion 70 and a time piece 72. The holder portion 70 includes an inverted T-shaped lower portion 74 which is receivable in the channel 52 of one of the channel members 12 or 14 through one end of channel 52 and an upper portion 76 which is dimensioned for slidably receiving the time piece 72. As illustrated in FIG. 1, when the holder portion 70 is received in one of the channels 52 it is operative for supporting the time piece 72 in upwardly spaced relation to the respective channel member 12 or 14. Although the assembly 20 is shown as comprising a time piece, it will be understood that the holder portion 70 could receive other articles, such as a calendar, advertising material, etc.

The writing instrument holder 22 is of generally conventional configuration and it includes a tubular holder portion 78 and a swivel mount 80 which is operative for securing the holder portion 78 to the channel member 12. The writing instrument 24 preferably comprises a conventional pen and it is receivable in the tubular holder portion 78 in a conventional manner.

The note pad 26 is also of conventional construction, although it is dimensioned to be received on the upper surface 48 of one of the channel members 12 or 14 so that it is maintained in position by the rails 58 and 60 of the respective channel member 12 or 14.

Accordingly, for use of the holder 10 one of the end caps 16 or 18 is removed from one of the channel members 12 or 14 and a dispenser 28 is assembled with the channel member 12 or 14 so that the body portion 32 of the dispenser 28 is positioned in the inner portion 54 of the channel 52 and so that the neck portion 34 projects upwardly in the mouth portion 56 of the channel 52. In this regard, by bending the card portion 40 downwardly slightly to the position illustrated in FIG. 3 the dispenser 28 can be wedged upwardly slightly in the channel 52 so that the neck portion 34 projects further upwardly through the mouth portion 56 and so that the dispenser 28 is frictionally maintained in its desired longitudinal position within the channel member. In any event, after the dispenser 28 has been assembled in the channel 52, the time piece assembly 20 can be similarly assembled in the channel 52 and thereafter, the end cap 16 can be assembled in one end of the channel member 12 and the end cap 18 can be assembled in the adjacent ends of the channel members 12 and 14 to interconnect the channel members 12 and 14 in substantially aligned end to end relation. Finally, the note pad 26 can be assembled on the channel member 12 so that it is positioned between the rails 58 and 60 on the upper surface 48 thereof. Once the holder 10 has been assembled in this manner the tape marker flags 30 can be easily dispensed from the dispenser 28 and sheets of paper can be dispensed from the note pad 26 as needed. Further, the time piece assembly 20 is positioned so that the time piece 72 is readily visible and the writing instrument 24 is positioned so that it is readily accessible for use when needed.

It is seen therefore that the instant invention provides an effective holder assembly for a dispenser for tape markers flags. The channel members 12 and 14 are dimensioned for receiving dispensers, such as the dispenser 28 in the channels 52 thereof. Further, the channel member 12 can be effectively utilized for supporting and positioning additional desk-top accessories such as the time piece 72 and the writing instrument 24 so that they are readily and conveniently available when needed. Still further, the channel members 12 and 14 can be effectively adapted to incorporate various advertising or logos thereon so that they can be effectively embodied as advertising specialty items. Also, as will be obvious, channel member 12 may be used as a single unit, i.e., without channel member 14 assembled thereto, in which case the interconnecting end cap 18 would not be used but rather both end caps would be the same as end cap 16. Accordingly, it it seen that the holder of the instant invention represents a significant advancement in the art relating to desk-top accessories, which advancement has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A holder for a dispenser for tape marker flags and the like wherein the dispenser includes a housing having an enlarged body portion and an upwardly extending open ended tubular neck portion of elongated cross sectional length and reduced cross sectional width on said body portion and a supply of tape marker flags in said body portion which are individually dispensable from said housing through said neck portion, said holder comprising a channel member having an upper surface and having a channel therein, said channel member being adapted to be received and supported on a supporting surface so that said upper surface faces upwardly, said channel including an enlarged inner portion and a reduced mouth portion which opens upwardly along said upper surface, said channel being open at one end thereof, said channel being dimensioned for receiving said dispenser therein through said open end and for positioning said dispenser so that said body portion is received in said channel inner portion and said neck portion extends upwardly into said mouth portion terminating adjacent said upper surface, said mouth portion being dimensioned for positioning said neck portion in substantially aligned relation therein and for preventing removal of said dispenser from said channel member therethrough.

2. In the holder of claim 1, said channel member further characterized as an elongated extruded channel member.

3. In the holder of claim 2, said channel being open at opposite ends of said channel member, said holder further comprising means removably closing the opposite ends of said channel.

4. In the holder of claim 3, said means removably closing the opposite ends of said channel further characterized as first and second end pieces removably received in opposite ends of said channel.

5. The holder of claim 4, further comprising a second one of said channel members, one of said first or second end pieces further comprising means releasably receivable in said second channel member for releasably connecting said channel members in substantially aligned relation.

6. The holder of claim 1 further comprising a time piece, and means releasably received in said channel and extending upwardly through said mouth portion for supporting said time piece in upwardly spaced relation to said channel member.

7. In the holder of claim 2, said upper surface being substantially flat, said holder further comprising a note pad received on said upper surface and rail means defining opposite substantially parallel longitudinally extending edges of said upper surface and engaging said note pad to retain said note pad in a predetermined position thereon.

8. The holder of claim 1 further comprising a writing instrument and writing instrument holder means on said channel member for releasably securing said writing instrument thereon.

9. In the holder of claim 4, each of said end pieces comprising an end plate and a plurality of fingers which extend outwardly from the end plate thereof, each of said end pieces being dimensioned to be received on an end of said channel member with the fingers of the end piece received in frictional engagement in the channel and the end plate thereof substantially covering the adjacent end of the channel.

10. In combination, a holder for a dispenser for tape marker flags and a dispenser for tape marker flags in said holder, said dispenser comprising a housing having an enlarged body portion and an upwardly extending open ended tubular neck portion of elongated cross sectional length and reduced cross sectional width on said body portion and a supply of tape marker flags in said body portion which are individually dispensable from said housing through said neck portion, said holder comprising a channel member having an upper surface and having a channel therein, said channel member being adapted to be received and supported on a supporting surface so that said upper surface faces upwardly, said channel including an enlarged inner portion and a reduced mouth portion which opens upwardly along said upper surface, said channel being open at one end thereof, said channel being dimensioned for receiving said dispenser therein through said open end and for positioning said dispenser so that said body portion is received in said channel inner portion and said neck portion extends upwardly into said mouth portion terminating adjacent said upper surface, said mouth portion being dimensioned for positioning said neck portion in substantially aligned relation therein and for preventing removal of said dispenser from said channel member therethrough, said dispenser being received in said channel member so that said body portion is received in said enlarged inner portion and said neck portion is received in substantially aligned relation in said mouth portion.

11. A holder for an article, wherein the article comprises an enlarged body portion and an upwardly extending neck portion of elongated cross sectional length and reduced cross sectional width on said body portion, said holder comprising a channel member having an upper surface and having a channel therein, said channel member being adapted to be received and supported on a supporting surface so that said upper surface faces upwardly, said channel including an enlarged inner portion and a reduced mouth portion which opens upwardly along said upper surface, said channel being open at one end thereof, said enlarged inner portion having a bottom surface, said channel being dimensioned for receiving said article therein through said open end and for positioning said article so that said body portion is received in said channel inner portion and supported on said bottom surface and so that said neck portion extends upwardly into said mouth portion terminating adjacent said upper surface, said mouth portion being dimensioned for positioning said neck portion in substantially aligned relation therein and for preventing removal of said article from said channel member therethrough.

12. A holder for an article, said article including a time piece support and a time piece supported on said time piece support, said time piece support including an enlarged body portion and an upwardly extending neck portion of elongated cross sectional length and reduced cross sectional width on said body portion, said holder comprising a channel member having an upper surface and having a channel therein, said channel member being adapted to be received and supported on a supporting surface so that said upper surface faces upwardly, said channel including an enlarged inner portion and a reduced mouth portion which opens upwardly along said upper surface, said channel being open at one end thereof, said channel being dimensioned for receiving said time piece support therein through said open end and for positioning said time piece support so that said body portion is received in said channel inner portion and said neck portion extends upwardly through said mouth portion for supporting said time piece in upwardly spaced relation to said channel member upper surface, said mouth portion being dimensioned for positioning said neck portion in substantially aligned relation therein and for preventing removal of said time piece support from said channel member therethrough.

* * * * *